US008867970B2

(12) United States Patent
Acosta et al.

(10) Patent No.: US 8,867,970 B2
(45) Date of Patent: Oct. 21, 2014

(54) TONER CARTRIDGES HAVING POSITIONAL CONTROL FEATURES

(75) Inventors: Benjer Albaran Acosta, Sarangani Province (PH); James Richard Leemhuis, Lexington, KY (US); Matthew Lee Rogers, Lexington, KY (US); Bryan Christopher Scharf, Richmond, KY (US); James Anthany Carter, II, Lexington, KY (US); Gary Neal Hackney, Georgetown, KY (US); Katrina Rosit Lactuan, Cebu (PH); Keith Seaman, Lexington, KY (US); Christopher Gene Vowels, Versailles, KY (US); Jason Hale, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 232 days.

(21) Appl. No.: 13/340,911

(22) Filed: Dec. 30, 2011

(65) Prior Publication Data

US 2013/0170867 A1 Jul. 4, 2013

(51) Int. Cl.
*G03G 15/08* (2006.01)
*G03G 21/18* (2006.01)

(52) U.S. Cl.
CPC ..... *G03G 21/1842* (2013.01); *G03G 21/185* (2013.01)
USPC ..... 399/262; 399/113; 399/258

(58) Field of Classification Search
CPC ..... G03G 21/1842; G03G 21/185
USPC ..... 399/113, 258, 262
See application file for complete search history.

(56) References Cited

U.S. PATENT DOCUMENTS 5,758,233 A 5/1998 Coffey et al.
5,768,661 A 6/1998 Coffey et al.

(Continued)

OTHER PUBLICATIONS

International Search Report and Written Opinion of the International Searching Authority dated Feb. 1, 2013 for PCT Application No. PCT/US12/65148 (7 pages).

(Continued)

*Primary Examiner* — David Gray
*Assistant Examiner* — Andrew V Do
(74) *Attorney, Agent, or Firm* — Justin M Tromp; John Victor Pezdek

(57) ABSTRACT

A toner cartridge for use in an image forming device according to one example embodiment includes a housing having a reservoir for containing toner therein. The housing has an exit port in fluid communication with the reservoir to permit toner from the reservoir to pass out of the housing. A first leg and a second leg each project from a bottom portion of the housing to limit the side-to-side travel of the toner cartridge during insertion into the image forming device. Wing guides are positioned on opposite side surfaces of the housing. A stop extends from each wing guide to limit the forward travel of the toner cartridge in the image forming device. Rounded projections extending from the bottom surfaces of the wing guides define contact points to control the vertical position of the toner cartridge in the image forming device.

13 Claims, 16 Drawing Sheets

(56) References Cited

U.S. PATENT DOCUMENTS

| | | | | |
|---|---|---|---|---|
| 6,014,536 | A | 1/2000 | Ban et al. | |
| 6,771,922 | B2 | 8/2004 | Blanck et al. | |
| 6,782,219 | B2 * | 8/2004 | Yoshino et al. | 399/90 |
| 7,548,710 | B2 | 6/2009 | Gayne et al. | |
| 7,606,520 | B2 | 10/2009 | Dawson | |
| 2006/0067725 | A1 | 3/2006 | Miyabe et al. | |
| 2006/0140664 | A1 | 6/2006 | Takami | |
| 2007/0212118 | A1 | 9/2007 | Nagae et al. | |
| 2007/0223965 | A1 | 9/2007 | Takagi | |
| 2008/0101821 | A1 | 5/2008 | Gayne et al. | |
| 2009/0142103 | A1 | 6/2009 | Chaudhuri et al. | |
| 2010/0221039 | A1 | 9/2010 | Kawai et al. | |

OTHER PUBLICATIONS

International Search Report and Written Opinion of the International Searching Authority dated Jan. 31, 2013 for PCT Application No. PCT/US12/65149 (7 pages).
Copending U.S. Appl. No. 13/780,060, filed Feb. 28, 2013.
Copending U.S. Appl. No. 13/340,935, filed Dec. 30, 2011.
Prosecution history of U.S. Appl. No. 13/780,060 including Non-Final Office Action dated Dec. 23, 2013.
Prosecution history of U.S. Appl. No. 13/340,935 including Non-Final Office Action dated May 22, 2014.
Prosecution history of U.S. Appl. No. 13/340,935 including Notice of Allowance dated Aug. 22, 2014.

* cited by examiner

TONER CARTRIDGES HAVING POSITIONAL CONTROL FEATURES

CROSS REFERENCES TO RELATED APPLICATIONS

This patent application is related to U.S. patent application Ser. No. 13/340,935, filed Dec. 30, 2011, entitled "Toner Cartridge for Use in an Image Forming Device," which is assigned to the assignee of the present application.

BACKGROUND

1. Field of the Disclosure

The present disclosure relates generally to toner cartridges used in to electrophotographic image forming devices and, more particularly, to a toner cartridge having positional control features.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

To deliver toner from the toner cartridge to the imaging unit, an auger in the toner cartridge may be used to feed toner from an exit port on the toner cartridge into an entrance port on the imaging unit and into a second auger that disperses the toner within the imaging unit. As the toner is drawn out of the toner cartridge, it is augured through a shutter used for sealing the exit port of the toner cartridge when it is not inserted in the printer.

In devices utilizing a separate toner cartridge and imaging unit, it is important that the toner cartridge and imaging unit are precisely aligned relative to one another within the image forming device. For example, if the exit port on the toner cartridge is misaligned with the entrance port on the imaging unit, severe toner leakage may occur resulting in mechanical and print quality defects. The toner cartridge and imaging unit must also be rigidly held in place after they are installed in the image forming device in order to prevent their positional alignment from being disturbed during operation. The requirement for tight positional control must be balanced with the need to permit the user to easily load and unload the imaging unit and the toner cartridge into and out of the image forming device. Accordingly, it will be appreciated that a toner cartridge having positional control features that permit precise alignment of the cartridge while permitting various angles of insertion of the cartridge into the image forming device is desired.

SUMMARY

A toner cartridge for use in an image forming device according to one example embodiment includes a housing having a reservoir for containing toner therein. The housing has an exit port in fluid communication with the reservoir to permit toner from the reservoir to pass out of the housing. A first leg and a second leg each project from a bottom portion of the housing and extend between a rear portion and a front portion of the housing to limit the side-to-side travel of the toner cartridge during insertion into the image forming device. A first wing guide is positioned on a first side surface of the housing and a second wing guide is positioned on a second side surface of the housing substantially parallel to the first wing guide. Each wing guide has a generally elongated body that extends between the rear portion and the front portion of the housing. A first stop extends from the first wing guide and a second stop extends from the second wing guide to limit the forward travel of the toner cartridge in the image forming device. A pair of rounded projections extending from a bottom surface of the first wing guide and a rounded projection extending from a bottom surface of the second wing guide define contact points to control the vertical position of the toner cartridge in the image forming device.

A toner cartridge for use in an image forming device according to another example embodiment includes a housing having a reservoir for containing toner therein. The housing has an exit port in fluid communication with the reservoir to permit toner from the reservoir to pass out of the housing. A first leg and a second leg each project from a bottom portion of the housing and extend between a rear portion and a front portion of the housing parallel to a direction of insertion of the toner cartridge into the image forming device. The first and second legs are spaced from each other on opposite sides of the housing to limit the side-to-side travel of the toner cartridge during insertion into the image forming device. A first wing guide is positioned on a first side surface of the housing and a second wing guide is positioned on a second side surface of the housing substantially parallel to the first wing guide. Each wing guide has a generally elongated body that extends between the rear portion and the front portion of the housing. A first stop extends from the first wing guide and a second stop extends from the second wing guide to limit the forward travel of the toner cartridge in the image forming device. A pair of rounded projections extending from a bottom surface of the first wing guide and a rounded projection extending from a bottom surface of the second wing guide collectively form three datum points defining a plane that controls the vertical position of the toner cartridge in the image forming device.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
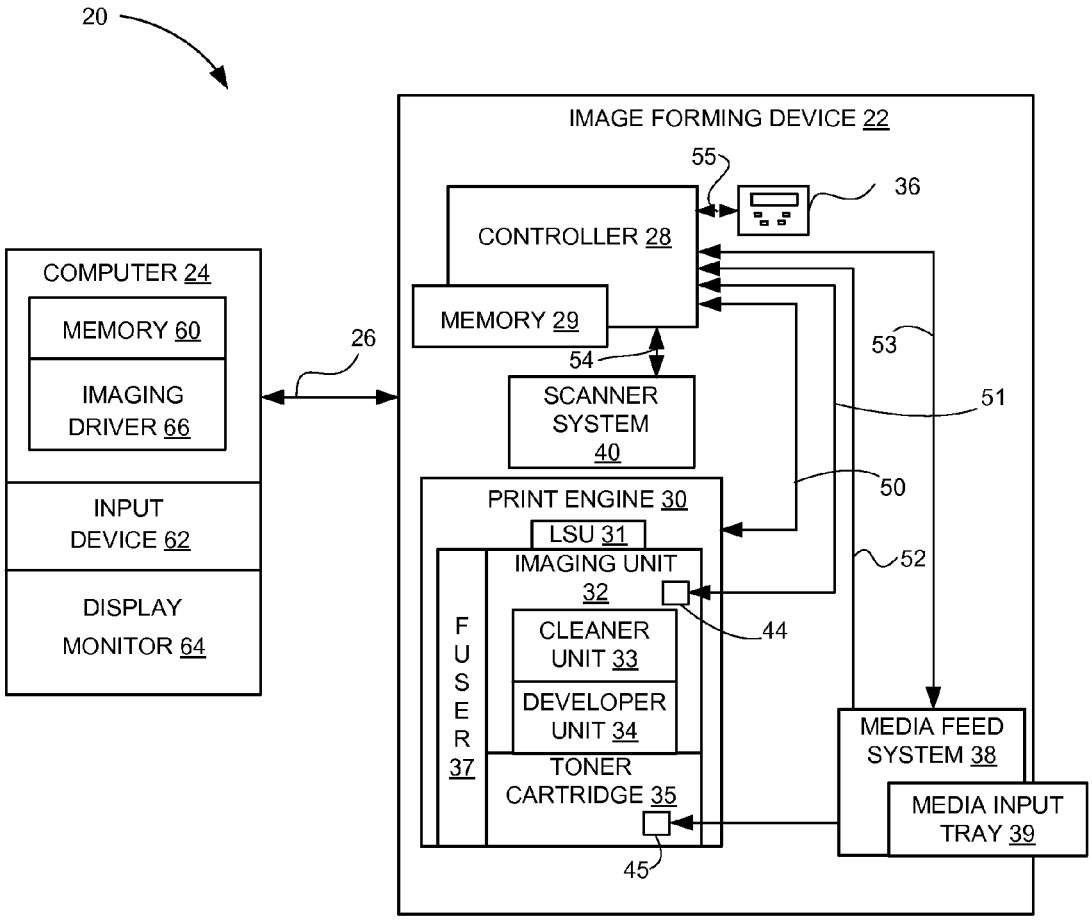
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined to printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
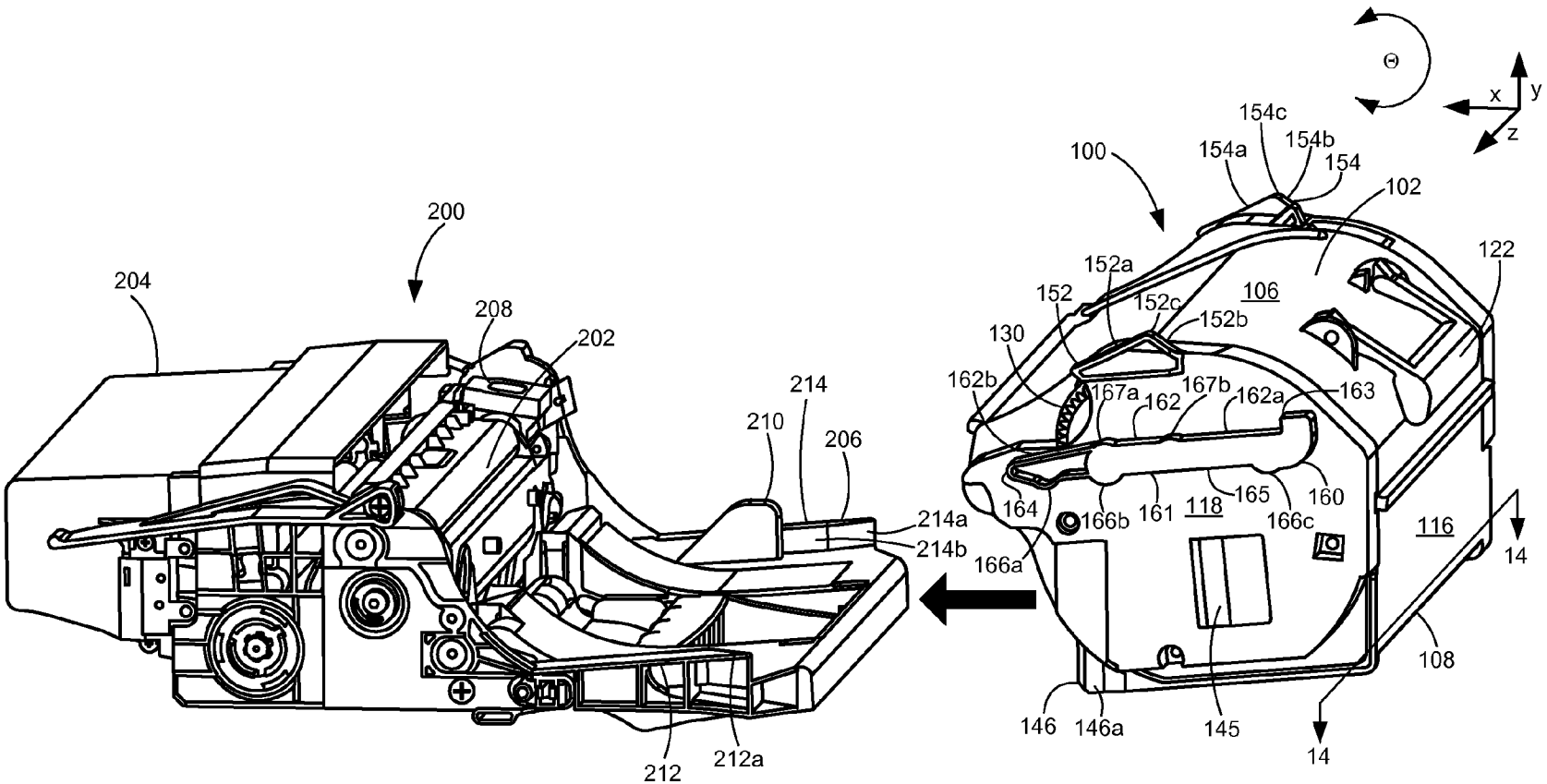
FIG. 2 is a perspective view of a toner cartridge and an imaging unit according to one example embodiment.

Referring now to FIG. 2, a toner cartridge 100 and an imaging unit 200 are shown according to one example embodiment. Imaging unit 200 includes a developer unit 202 and a cleaner unit 204 mounted on a common frame 206. Imaging unit 200 and toner cartridge 100 are each removably installed in image forming device 22 along a common entry path. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge without having to remove imaging unit 200. Imaging unit 200 may also be readily removed as desired in order to maintain, repair or replace the components associated with developer unit 202, cleaning unit 204 or frame 206 or to clear a media jam.

With reference to FIGS. 2-5, toner cartridge 100 includes a housing 102 having an enclosed reservoir 104 (FIG. 5) for holding a quantity of toner therein. Housing 102 may be viewed as having a top or lid 106 mounted on a base 108. Base 108 includes first and second side walls 110, 112 connected to adjoining front and rear walls 114, 116. In one embodiment, top 106 is ultrasonically welded to base 108 thereby forming enclosed reservoir 104. Housing 102 also includes first and second end caps 118, 120 that are mounted to side walls 110, 112, respectively. First and second end caps 118, 120 may be snap fitted into place or attached by screws or other fasteners. A handle 122 may be provided on top 106 or base 108 of toner cartridge 100 to assist with insertion and removal of toner cartridge 100 from imaging unit 200 and image forming device 22. As shown in FIG. 6, a fill port 124 is provided on side wall 112 that is used to fill toner cartridge 100 with toner. After filling, fill port 124 is closed by a plug 126 and/or cap 128.

Figure 3:
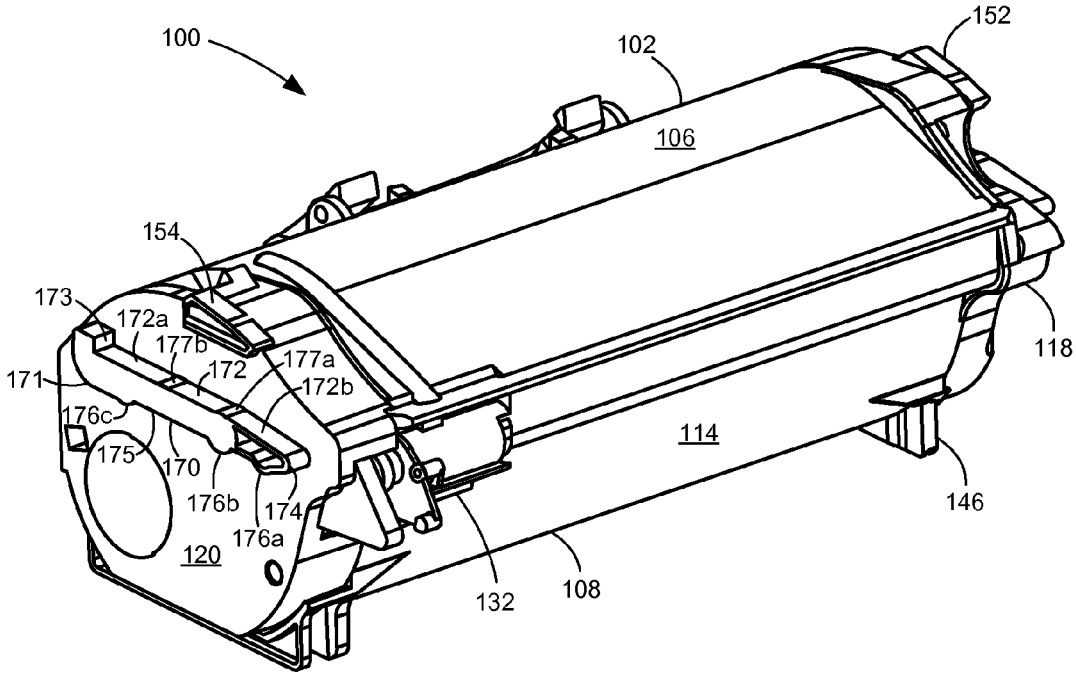
FIGS. 3 and 4 are additional perspective views of the toner cartridge shown in FIG. 2.
Figure 5:
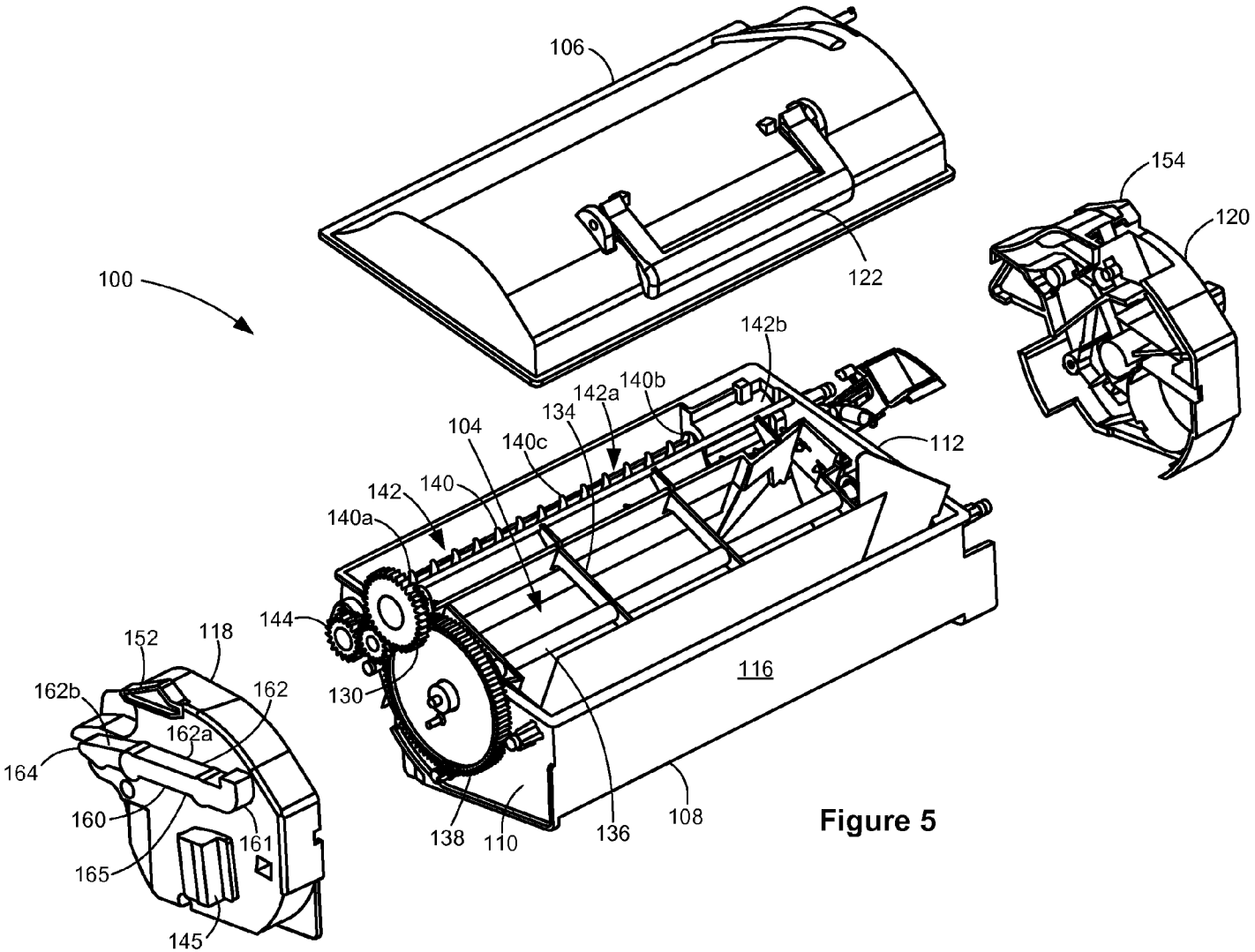
FIGS. 5 and 6 are exploded views of the toner cartridge shown in FIG. 2 showing a reservoir for holding toner therein.
Figure 6:
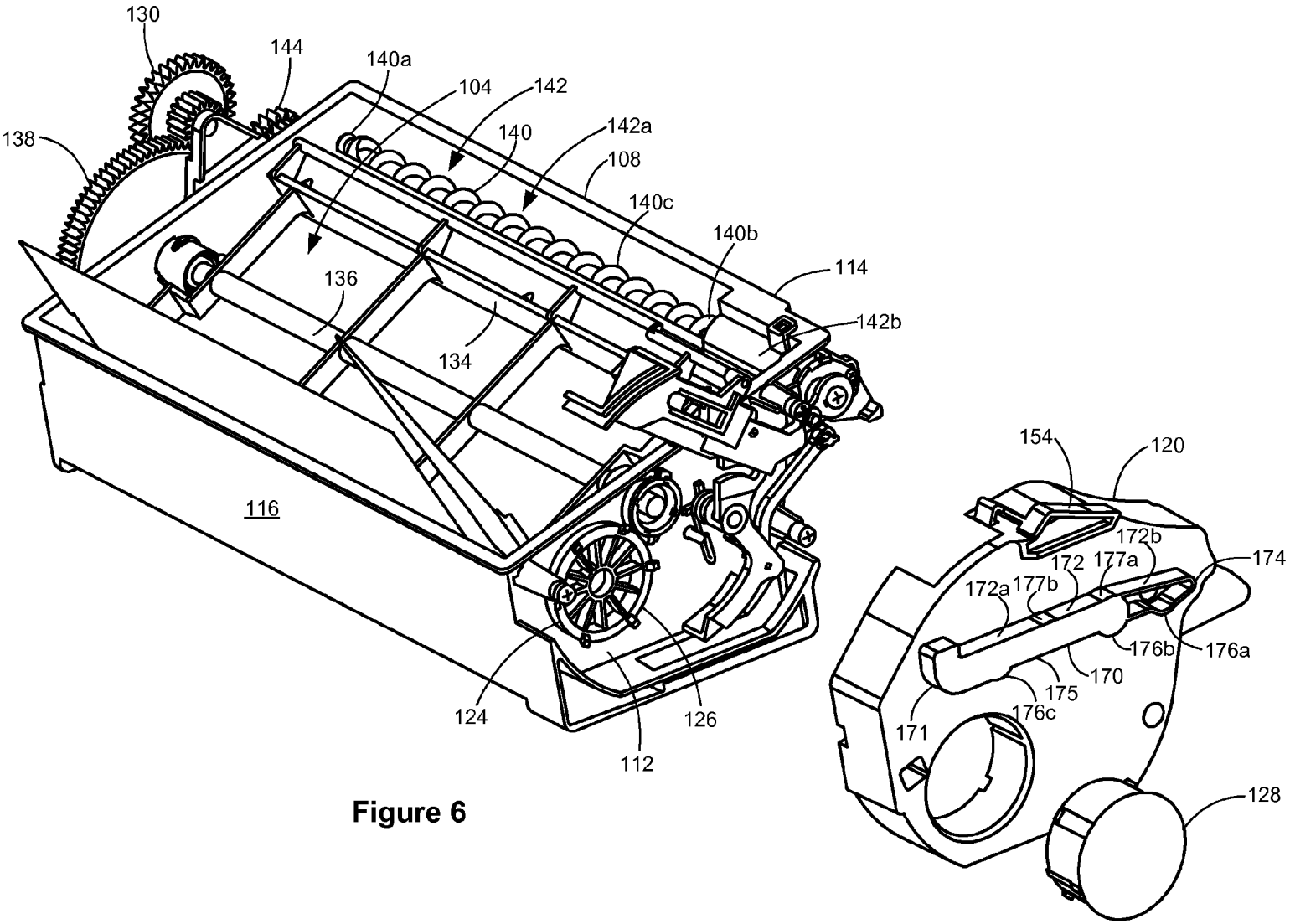

With reference to FIG. 5, various drive gears are housed within a space formed between end cap 118 and side wall 110. A main interface gear 130 engages with a drive system in image forming device 22 that provides torque to main interface gear 130. Various linkages may be housed within a space formed between end cap 120 and side wall 112 for actuating a shutter that regulates the flow of toner out of an exit port 132 provided in front wall 114 (FIG. 3). One or more paddles 134 are rotatably mounted within toner reservoir 104 with first and second ends of a drive shaft 136 of paddle(s) 134 extending through aligned openings in side walls 110, 112, respectively. A drive gear 138 is provided on the first end of drive shaft 136 that engages with main interface gear 130 either directly or via one or more intermediate gears. Bushings may be provided one each end of drive shaft 136 where it passes through side walls 110, 112. Accordingly, side wall 110 may also be termed the "drive" or "driven" side of toner cartridge 100.

With reference to FIGS. 5 and 6, an auger 140 having first and second ends **140*a*, 140*b*, and a spiral screw flight 140*c* is positioned in a channel 142 extending along the width of front wall 114 between side walls 110, 112. Channel 142 may be integrally molded as part of front wall 114 or formed as a separate component that is attached to front wall 114. Channel 142 is generally horizontal in orientation along with toner cartridge 100 when toner cartridge 100 is installed in image forming device 22. First end 140*a* of auger 140 extends through side wall 110 and a drive gear 144 is provided on first end 140*a* that engages with main interface gear 130 either directly or via one or more intermediate gears. Channel 142 includes an open portion 142*a* and an enclosed portion 142*b*. Open portion 142*a* is open to toner reservoir 104 and extends from side wall 110 toward second end 140*b* of auger 140. Enclosed portion 142*b* of channel 142 extends from side wall 112 and encloses second end 140*b* of auger 140 and the shutter that regulates whether toner is permitted to exit toner cartridge 100 through exit port 132. As paddle(s) 134 rotate, they deliver toner from toner reservoir 104 into open portion 142*a* of channel 142. Auger 140 is rotated via drive gear 144 to deliver toner received in channel 142 to the shutter housed in enclosed portion 142*b* of channel 142. In this embodiment, exit port 132 is disposed at the bottom of channel 142 so that gravity will assist in exiting toner through exit port 132 (FIG. 3**).

With reference back to FIG. 2, when toner cartridge 100 is installed in image forming device 22, its various interface features must align with corresponding interface features on imaging unit 200 and image forming device 22. In its final position in image forming device 22, toner cartridge 100 is positioned above frame 206 of imaging unit 200 with exit port 132 (FIG. 3) aligned and mated with an entrance port 208 on developer unit 202. In its final position, toner cartridge 100 does not apply a loading force on developer unit 202. As discussed above, exit port 132 and entrance port 208 must be precisely aligned in order to prevent toner leakage between toner cartridge 100 and developer unit 202. Further, main interface gear 130, which is exposed on front wall 114 between side wall 110 and end cap 118, must align and mate with a corresponding drive gear in image forming device 22 that provides torque to main interface gear 130. If main interface gear 130 is misaligned, proper gear mesh may not be achieved, which may result in gear cogging. In addition, electrical contacts for processing circuitry 45 of toner cartridge 100 positioned within a connector 145 on end cap 118 must align and mate with corresponding electrical contacts in image forming device 22 in order to permit communication between toner cartridge 100 and image forming device 22. The positions of these various interface points must be tightly controlled in order to ensure proper operation of toner cartridge 100. As a result, toner cartridge 100 must be properly positioned from front-to-rear (direction "x" in FIG. 2), vertically (direction "y") and side-to-side or axially (direction "z"). The angle of insertion of toner cartridge ("Θ"), also referred to as yaw, must also be controlled to within an acceptable range in order to ensure proper positioning.

Figure 7:
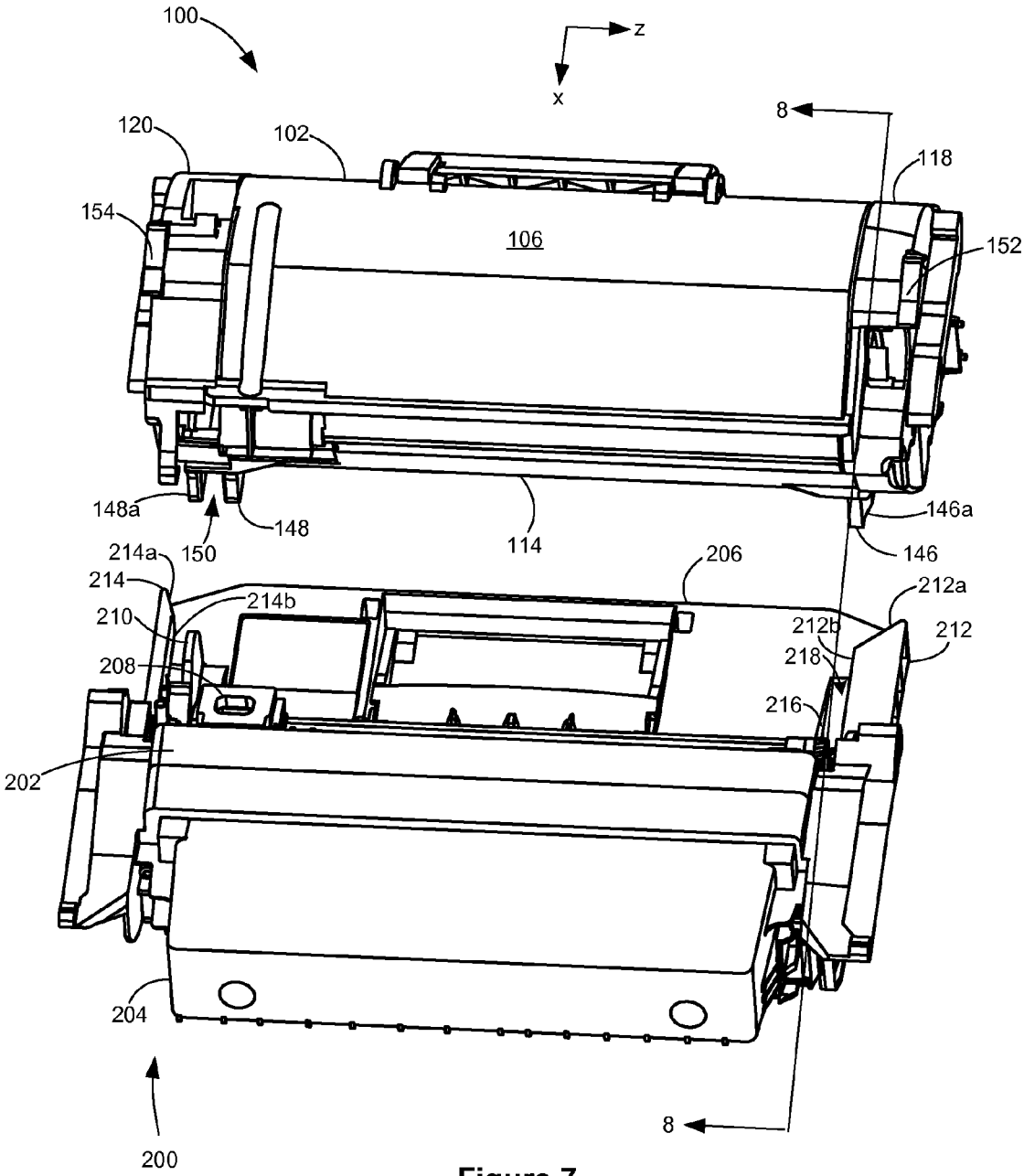
FIG. 7 is a top perspective view of the toner cartridge and imaging unit shown in FIG. 2.

With reference to FIGS. 2 and 7, toner cartridge 100 and imaging unit 200 include both coarse and fine axial positioning features. Toner cartridge 100 includes a pair of to legs 146, 148 projecting downward from base 108. Legs 146, 148 are spaced along axial direction "z" from each other between end caps 118, 120. Legs 146, 148 extend along base 108 from a rear portion of toner cartridge toward front wall 114 parallel to direction of insertion "x." A front portion of leg 148 includes a slot 150 therein that permits an engagement feature on frame 206, such as a fin 210, to engage the linkages positioned between end cap 118 and side wall 110 to open the shutter when toner cartridge 100 is inserted into image forming device 22. Frame 206 of imaging unit 200 includes a pair of vertical walls 212, 214 that correspond with legs 146, 148. Each vertical wall 212, 214 includes a beveled front surface 212*a*, 214*a* that is outwardly angled with respect to the direction of insertion "x" and faces toner cartridge 100 as toner cartridge 100 advances toward imaging unit 200. Each vertical wall 212, 214 also includes an inner surface 212*b*, 214*b* that is substantially parallel to the direction of insertion "x" of toner cartridge 100. Inner surfaces 212*b*, 214*b* are spaced inward from front surfaces 212*a*, 214*a*, respectively, along direction "x" toward developer unit 202. As toner cartridge 100 is inserted into image forming device 22, front surfaces 212*a*, 214*a* guide toner cartridge 100 toward developer unit 202 and limit the travel of toner cartridge 100 in the axial direction "z." If toner cartridge 100 is misaligned in the axial direction "z" during insertion, an outer surface 146*a*, 148*a* of one of its legs 146, 148 will contact the corresponding front surface 212*a* or 214*a* of vertical walls 212, 214. The angle of the front surface 212*a* or 214*a* will then urge toner cartridge 100 toward its proper axial alignment thereby providing coarse positional control as toner cartridge 100 advances toward developer unit 202.

Figure 8:
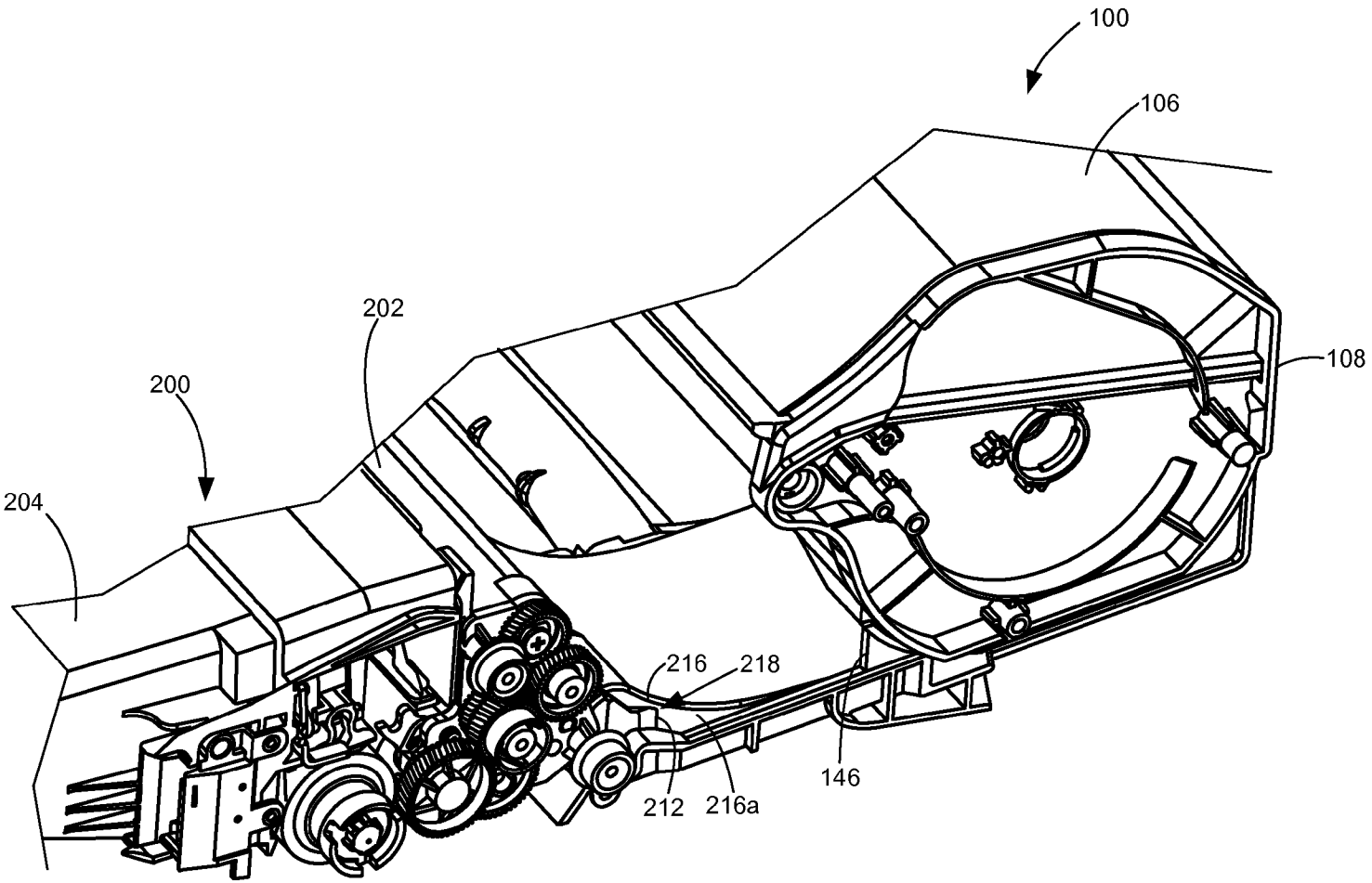
FIG. 8 is a cross-sectional view of the toner cartridge and imaging unit taken along line 8-8 in FIG. 7 with the toner cartridge advanced closer to the imaging unit.

As toner cartridge 100 is advanced further, outer surfaces 146*a*, 148*a* of legs 146, 148 are restrained between inner surfaces 212*b*, 214*b* of vertical walls 212, 214 further limiting the travel of toner cartridge 100 in the axial direction. In the example embodiment illustrated, the distance between outer surface 146*a* of leg 146 and outer surface 148*a* of leg 148 is between about 266 mm and about 269 mm. These coarse axial control features lead to fine axial control features in the form of a tightly controlled slot and tab interface shown in FIG. 8. FIG. 8 illustrates a cross-sectional view of toner cartridge 100 and imaging unit 200 taken along line 8-8 in FIG. 7 with toner cartridge 100 advanced closer to imaging unit 200. As shown in FIG. 8, a vertical wall 216 is spaced inward from vertical wall 212 along axial direction "z" forming a slot 218 therebetween. Specifically, slot 218 is formed between inner surface 212*b* of vertical wall 212 and an outer surface 216*a* of vertical wall 216. As toner cartridge 100 is advanced closer to developer unit 202, a front portion of leg 146 is received in slot 218 in frame 206 permitting slot 218 to tightly maintain the axial position of toner cartridge 100 as discussed in greater detail below.

Figure 4:
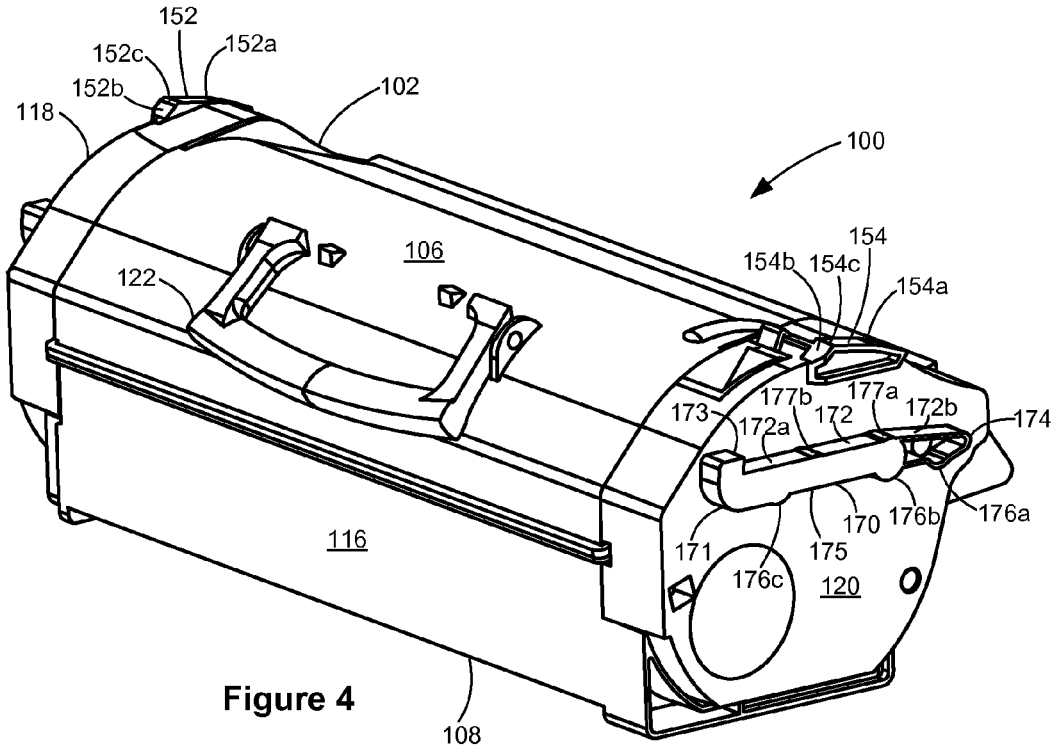
Figure 9:
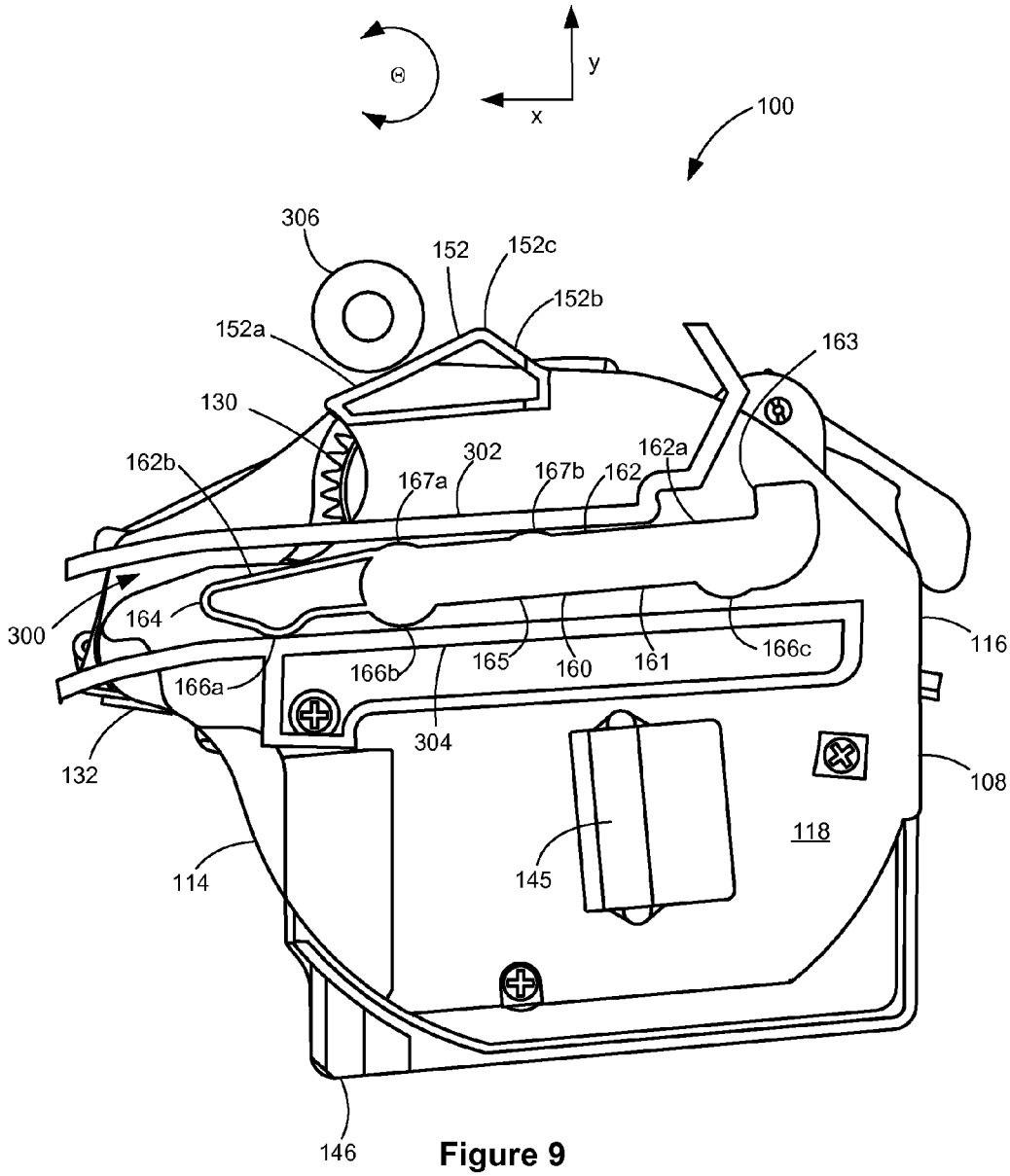
FIG. 9 is a side elevation view of the toner cartridge shown in FIG. 2 as it is loaded into an image forming device.
Figure 10:
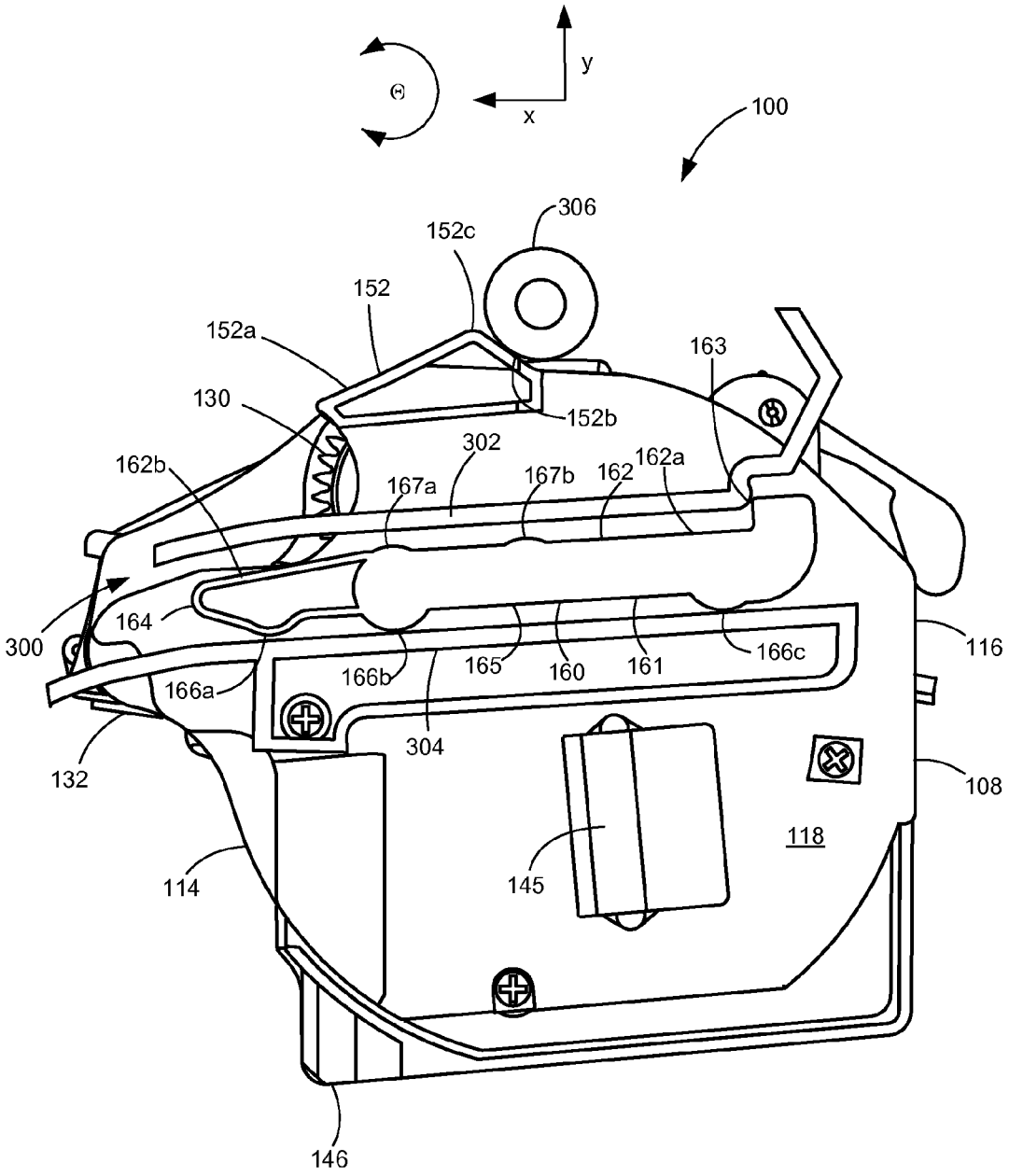
FIG. 10 is a side elevation view of the toner cartridge shown in FIG. 2 in its final position in the image forming device.
Figure 11:
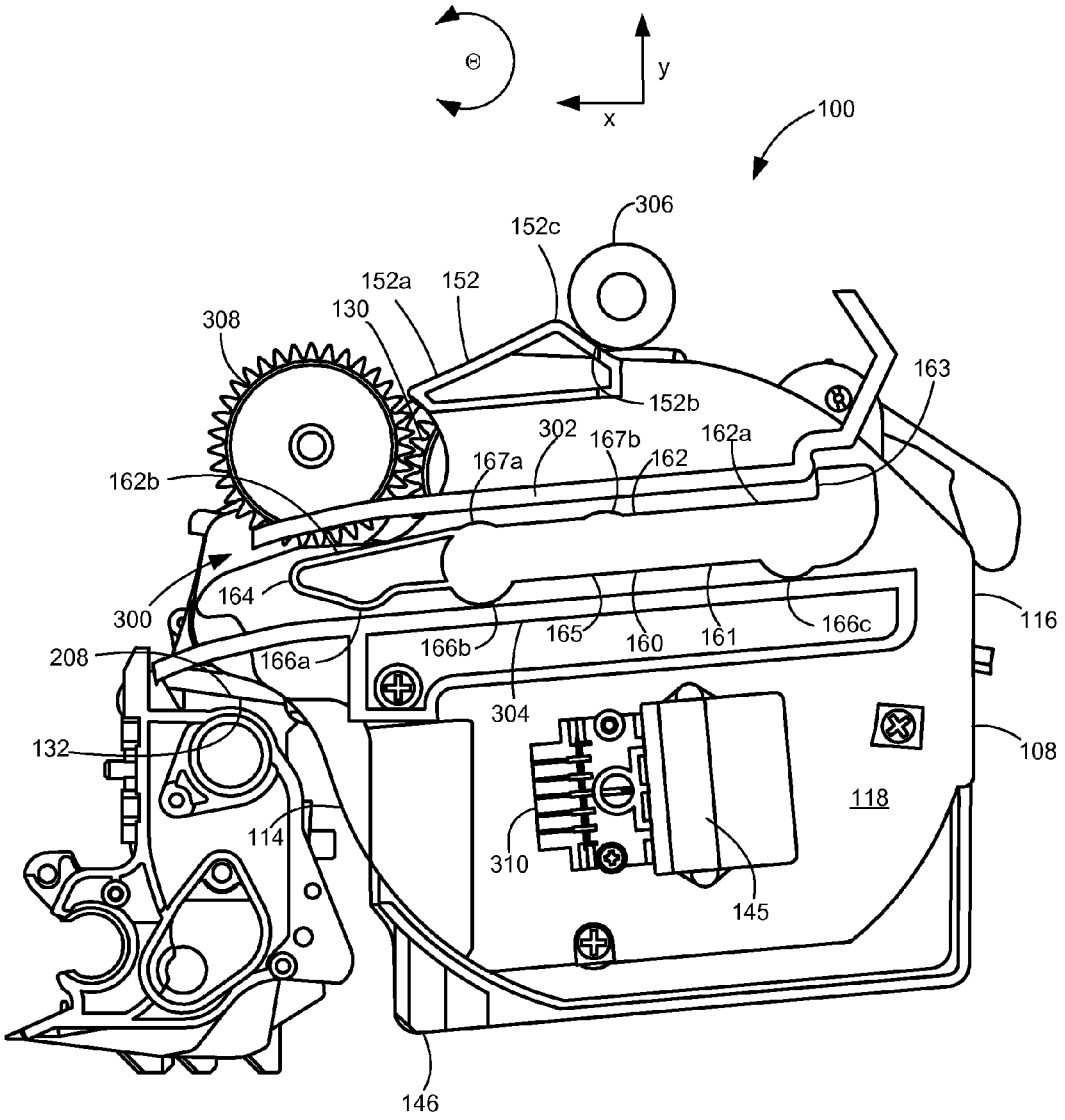
FIG. 11 is a side elevation view of the toner cartridge shown in FIG. 2 in its final position in the image forming device showing the engagement of various interface features.

With reference to FIGS. 9-11, the side surface of each end cap 118, 120 includes a wing guide 160, 170 (for end cap 120 and wing guide 170 see FIGS. 3 and 4). Each wing guide 160, 170 includes a generally elongated body 161, 171 that extends from a rear portion of its end cap 118, 120 toward a front portion thereof. Wing guides 160, 170 are substantially parallel to each other. As toner cartridge 100 is inserted into image forming device 22, wing guides 160, 170 each travel in a predetermined insertion path 300 defined by top and bottom guides 302, 304 running along an inner surface of image forming device 22. A top surface 162, 172 of each wing guide 160, 170 includes a substantially planar rear portion 162*a*, 172*a* that extends from a rear portion of its end cap 118, 120 toward a front portion thereof. Each top surface 162, 172 also includes a front portion 162*b*, 172*b* that is angled downward with respect to rear portion 162*a*, 172*a*, respectively. A stop 163, 173 extends vertically upward from each top surface 162, 172, respectively, that limits the forward travel of toner cartridge 100 as it is inserted into image forming device 22 as discussed in greater detail below. Each wing guide 160, 170 also includes a tapered nose 164, 174, respectively, forming a front tip thereof. In the example embodiment illustrated, a bottom surface 165, 175 of each respective wing guide 160, 170 includes three rounded projections 166*a*, 166*b*, 166*c* and 176*a*, 176*b*, 176*c* that define contact points with bottom guide 304 of image forming device 22. Wing guides 160, 170 are sometimes referred to as "dog bone" shaped because of the shape formed by bodies 161, 171 combined with rounded projections 166*b*, 166*c* and 176*b*, 176*c*. Top surface 162, 172 of each respective wing guide 160, 170 includes a pair of rounded projections 167*a*, 167*b*, 177*a* and 177*b*.

Each end cap 118, 120 also includes an engagement surface 152, 154 projecting upwardly from a top portion of the respective end cap 118, 120. Each engagement surface 152, 154 includes an angled front surface 152*a*, 154*a* that faces imaging unit 200 during insertion and an angled rear surface 152*b*, 154*b* that faces away from imaging unit 200 during insertion.

With reference to FIG. 9, as toner cartridge 100 is first inserted into image forming device 22, a roller 306 in image forming device 22 that is biased into the insertion path of toner cartridge 100 contacts front surfaces 152*a*, 154*a* of engagement surfaces 152, 154. The force applied to toner cartridge 100 by roller 306 controls the entry of toner to cartridge 100 and prevents it from advancing into image forming device 22 too quickly. Further, as toner cartridge 100 is first inserted into image forming device 22, the downwardly angled front portions 162*b*, 172*b* and tapered nose 164, 174 of wing guides 160, 170 provide the user with a relatively broad range of permissible angles of insertion Θ (or yaw). As toner cartridge 100 advances, the insertion angle is limited by projections 167*a*, 167*b*, 177*a*, 177*b* on top surfaces 162, 172 and front projections 166*a*, 176*a* on bottom surfaces 165, 175 as shown.

With reference to FIG. 10, as toner cartridge 100 is advanced to its final position, roller 306 passes over an apex 152*c*, 154*c* of each engagement surface 152, 154 until it contacts rear surfaces 152*b*, 154*b*. The force applied by roller 306 to rear surfaces 152*b*, 154*b* of toner cartridge 100 urges toner cartridge 100 to its final position in image forming device 22. As toner cartridge 100 advances, stops 163, 173 contact top guide 302 in image forming device 22 to prevent toner cartridge 100 from advancing further thereby controlling the front-to-rear horizontal positioning of toner cartridge 100 along direction "x." The vertical position of toner cartridge 100 along direction "y" is controlled by the contact between rounded projections 166*b*, 166*c*, 176*b*, 176*c* and bottom guides 304 in image forming device 22. Specifically, three of the four rounded projections 166*b*, 166*c*, 176*b*, 176*c* form datum points that define a plane that determines the vertical position of toner cartridge 100. For example, in the example embodiment shown, the radii of rounded projections 166*b*, 166*c* and 176*b* are the same while the radius of rounded projection 176*c* is slightly smaller. As a result, in this embodiment, rounded projections 166*b*, 166*c* and 176*b* control the vertical position of toner cartridge 100.

With reference to FIG. 11, accurate positioning of toner cartridge 100 permits proper alignment between the various interface features of toner cartridge 100 and the corresponding interface features on imaging unit 200 and image forming device 22. As shown, in its final position, exit port 132 of toner cartridge 100 is aligned and mated with entrance port 208 on developer unit 202. Main interface gear 130 is aligned and mated with a corresponding drive gear 308 in image forming device 22. Electrical contacts for the processing circuitry in connector 145 are aligned and mated with corresponding electrical contacts on a connector 310 in image forming device 22. The positional control features of toner cartridge 100 ensure that these interface points are tightly controlled in order to ensure proper operation of toner cartridge 100. During operation, the force applied by roller 306 on rear surfaces 152*b*, 154*b* of engagement surfaces 152, 154 holds toner cartridge 100 in to position and prevents it from separating from entrance port 208, drive gear 308 or electrical contacts 310.

Figure 12A:
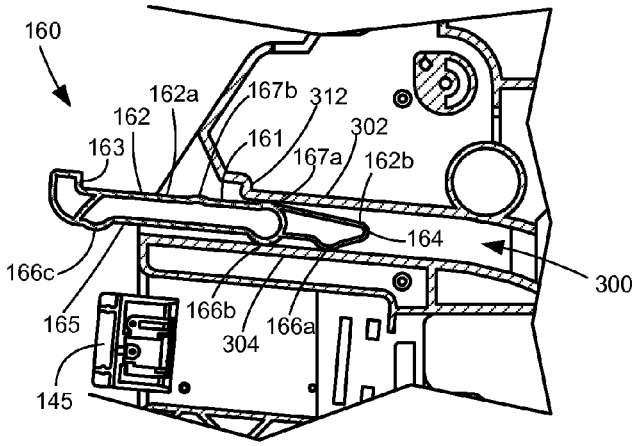
FIGS. 12A-C are sequential views of a first wing guide on the toner cartridge advancing in a corresponding insertion path in the image forming device according to one example embodiment.
Figure 12B:
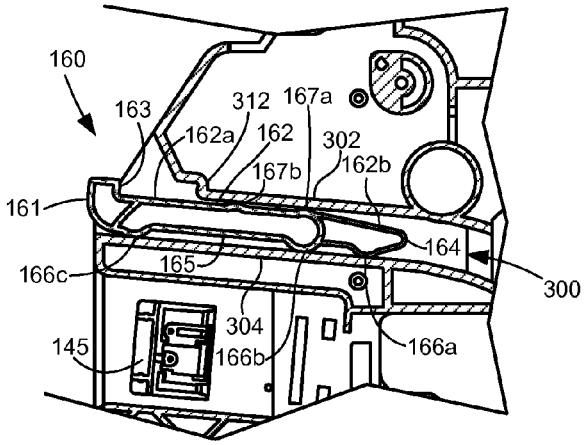
Figure 12C:
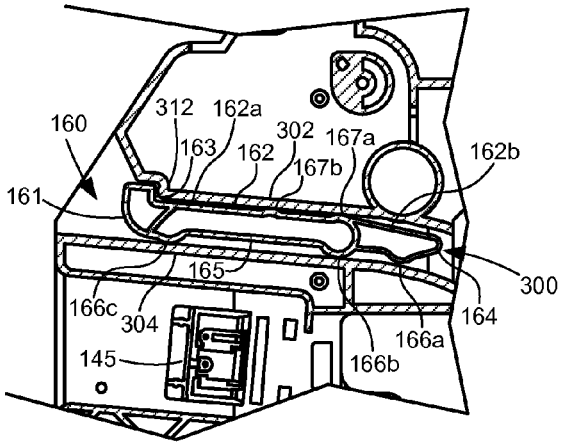
Figure 13A:
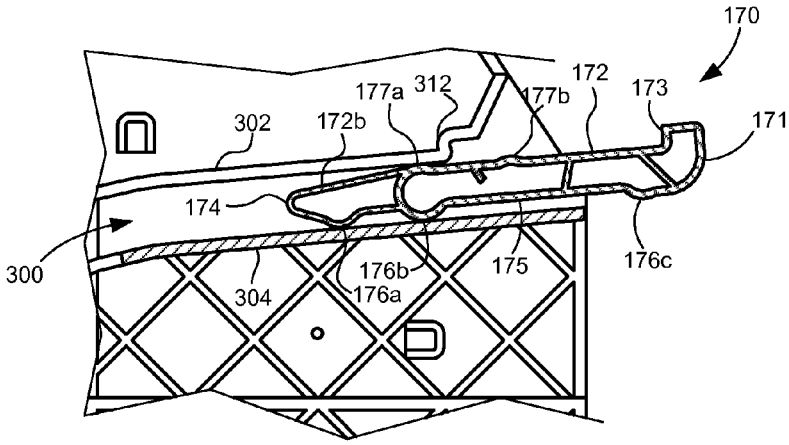
FIGS. 13A-C are sequential views of a second wing guide on the toner to cartridge advancing in a corresponding insertion path in the image forming device according to one example embodiment.
Figure 13B:
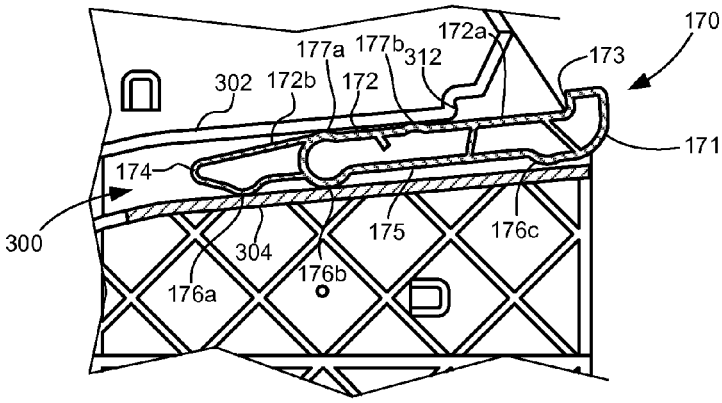
Figure 13C:
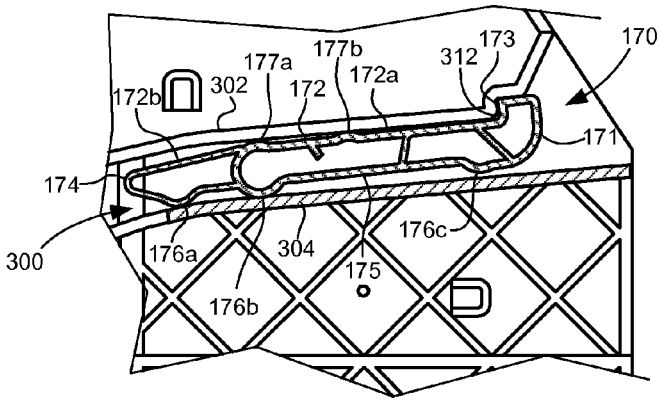
Figure 14A:
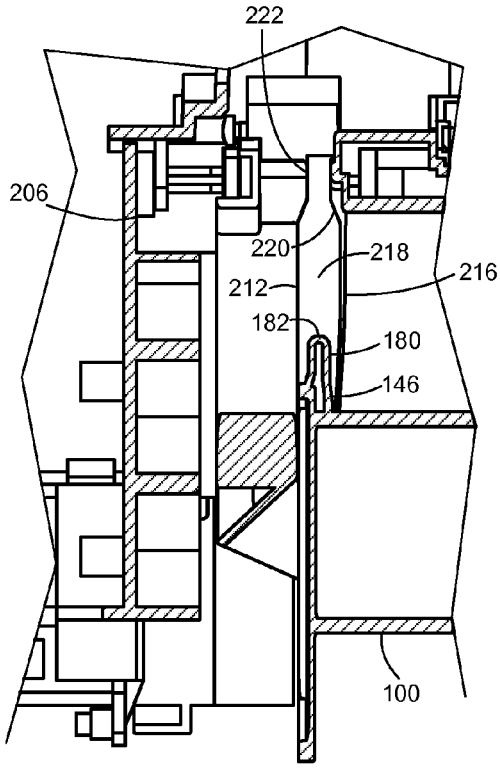
FIGS. 14A-C are sequential cross-sectional views of a leg of the toner cartridge taken along line 14-14 in FIG. 2 as the toner cartridge is inserted into the image forming device according to one example embodiment.
Figure 14B:
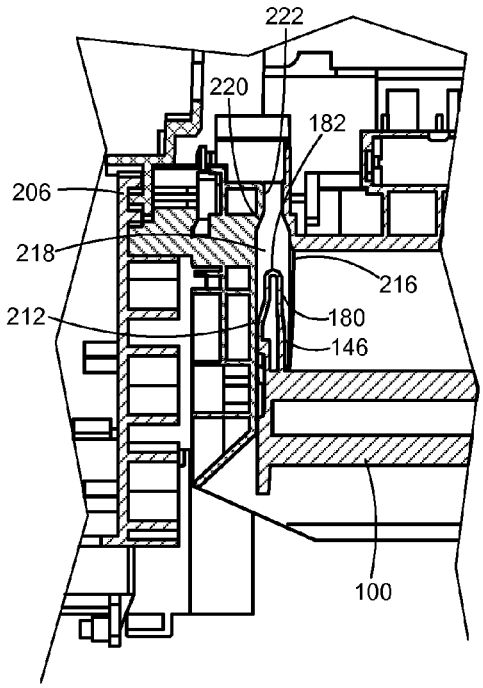
Figure 14C:
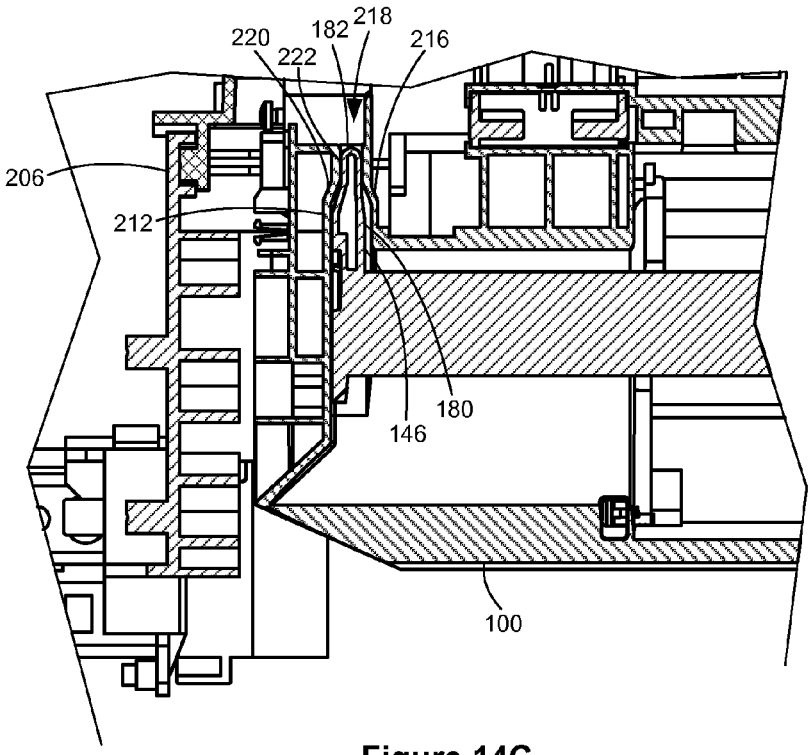

FIGS. 12A-C, 13A-C and 14A-C are sequential views illustrating the insertion of toner cartridge 100 into image forming device 22. FIGS. 12A-C and 13A-C show the positions of wing guides 160, 170, respectively, relative to insertion path 300 as toner cartridge 100 is inserted into image forming device 22. FIGS. 14A-C show cross-sectional views of leg 146 of toner cartridge 100 taken along line 14-14 in FIG. 2. FIGS. 12A, 13A and 14A show a first sequence view as toner cartridge 100 is initially inserted into image forming device 22. Specifically, FIGS. 12A and 13A show wing guides 160, 170, respectively, entering their respective insertion paths 300. FIG. 14A shows a front portion 180 of leg 146 entering slot 218 in frame 206. As illustrated, front portion 180 of leg 146 tapers in width forming a tab or nose 182 at a front tip thereof. In one embodiment, the width of nose 182 is between about 5 mm and about 9 mm. Slot 218 includes a corresponding tapered lead-in 220 to receive and guide front portion 180 of leg 146 into slot 218. Slot 218 also includes an inner slot portion 222 sized to tightly receive nose 182. FIGS. 12B, 13B and 14B show a second sequence view as toner cartridge 100 is advanced further into image forming device 22. FIGS. 12B and 13B show wing guides 160, 170, respectively, advanced further along their respective insertion paths 300. FIG. 14B shows front portion 180 of leg 146 advanced further in slot 218. FIGS. 12C, 13C and 14C show a final sequence view with toner cartridge 100 fully inserted into image forming device 22 and mated with developer unit 202. FIGS. 12C and 13C show stops 163, 173 engaged with a corresponding lip or rounded stop 312 in image forming device 22. Stops 312 control the position of toner cartridge 100 in the direction of insertion and ensure that toner cartridge 100 is not over-inserted into image forming device 22. FIGS. 12C and 13C also show rounded projections 166*b*, 166*c* and 176*b*, positioned on bottom guide 304 and rounded projections 166*a*, 176*a* and 176*c* spaced from bottom guide 304. As discussed above, in this embodiment, rounded projections 166*b*, 166*c* and 176*b* define a plane that controls the vertical position of toner cartridge 100. FIG. 14C shows nose 182 tightly positioned in inner slot portion 222 to control the axial position of toner cartridge 100.

Figure 15:
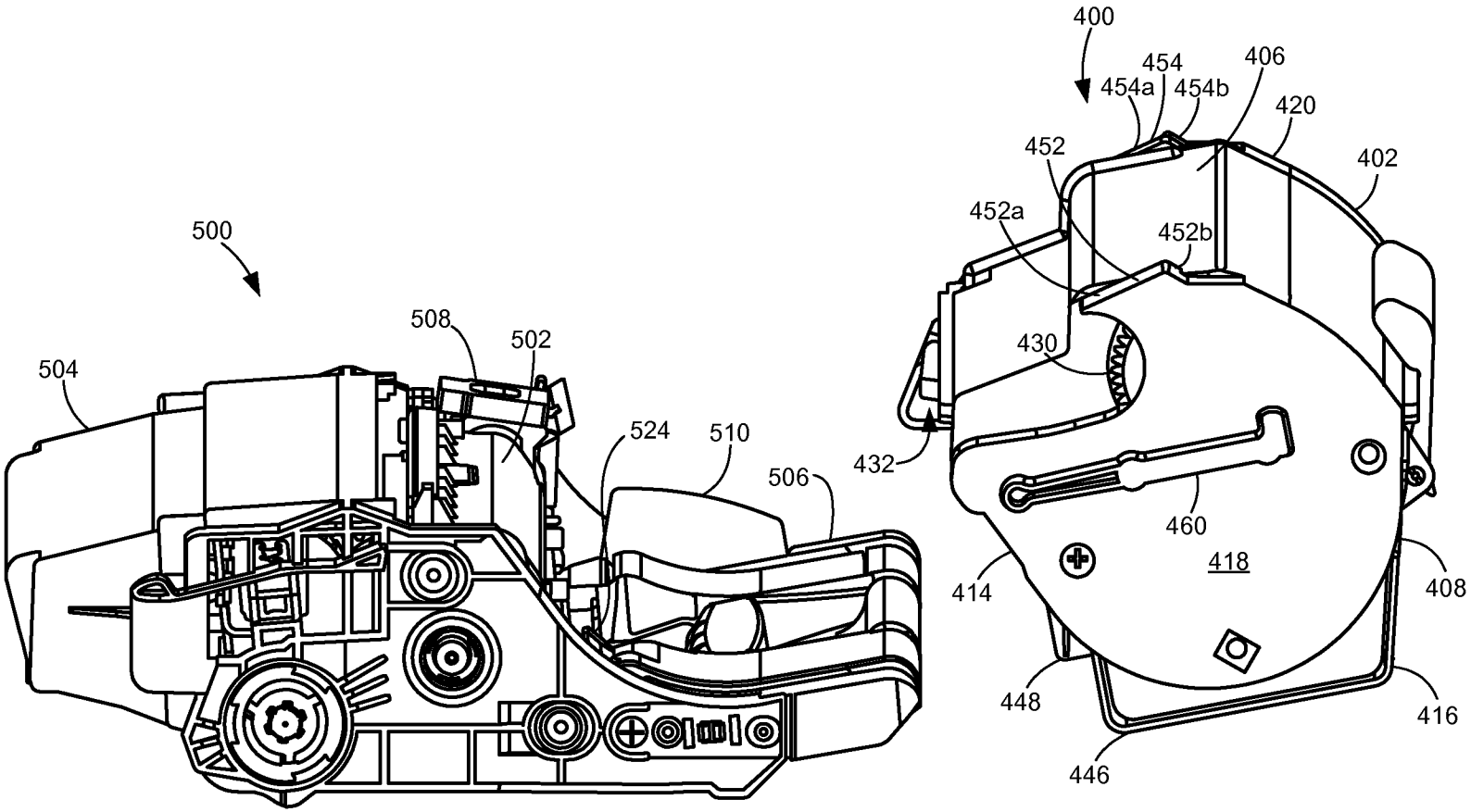
FIG. 15 is a perspective view of a toner cartridge and an imaging unit according to a second example embodiment.

FIG. 15 shows a toner cartridge 400 having positional control features and a corresponding imaging unit 500 according to a second example embodiment. Imaging unit 500 includes a developer unit 502 and a cleaner unit 504 mounted on a common frame 506. Developer unit 502 includes an entrance port 508 for receiving toner from toner cartridge to 400. Frame 506 includes a projection 510 for actuating a shutter that regulates the flow of toner out of toner cartridge 400 similar to fin 210 discussed above. As discussed above, imaging unit 500 and toner cartridge 400 are each removably installed in image forming device 22. In its final position, toner cartridge 400 is in a mating relationship with developer unit 502 of imaging unit 500. Toner cartridge 400 includes a housing 402 having a top or lid 406 mounted on a base 408. Base 408 includes first and second side walls connected to adjoining front and rear walls 414, 416. First and second end caps 418, 420 are mounted to the side walls, respectively. A main interface gear 430 is exposed on front wall 414 between end cap 418 and its respective side wall. Main interface gear engages with a drive system in image forming device 22 that provides torque to main interface gear 430. An exit port 432 is disposed on front wall 414 in a downward facing orientation so that gravity will assist in exiting toner through exit port 432. Toner cartridge 400 also includes electrical contacts for processing circuitry positioned within a connector 445 on end cap 420 (FIG. 16).

Figure 16:
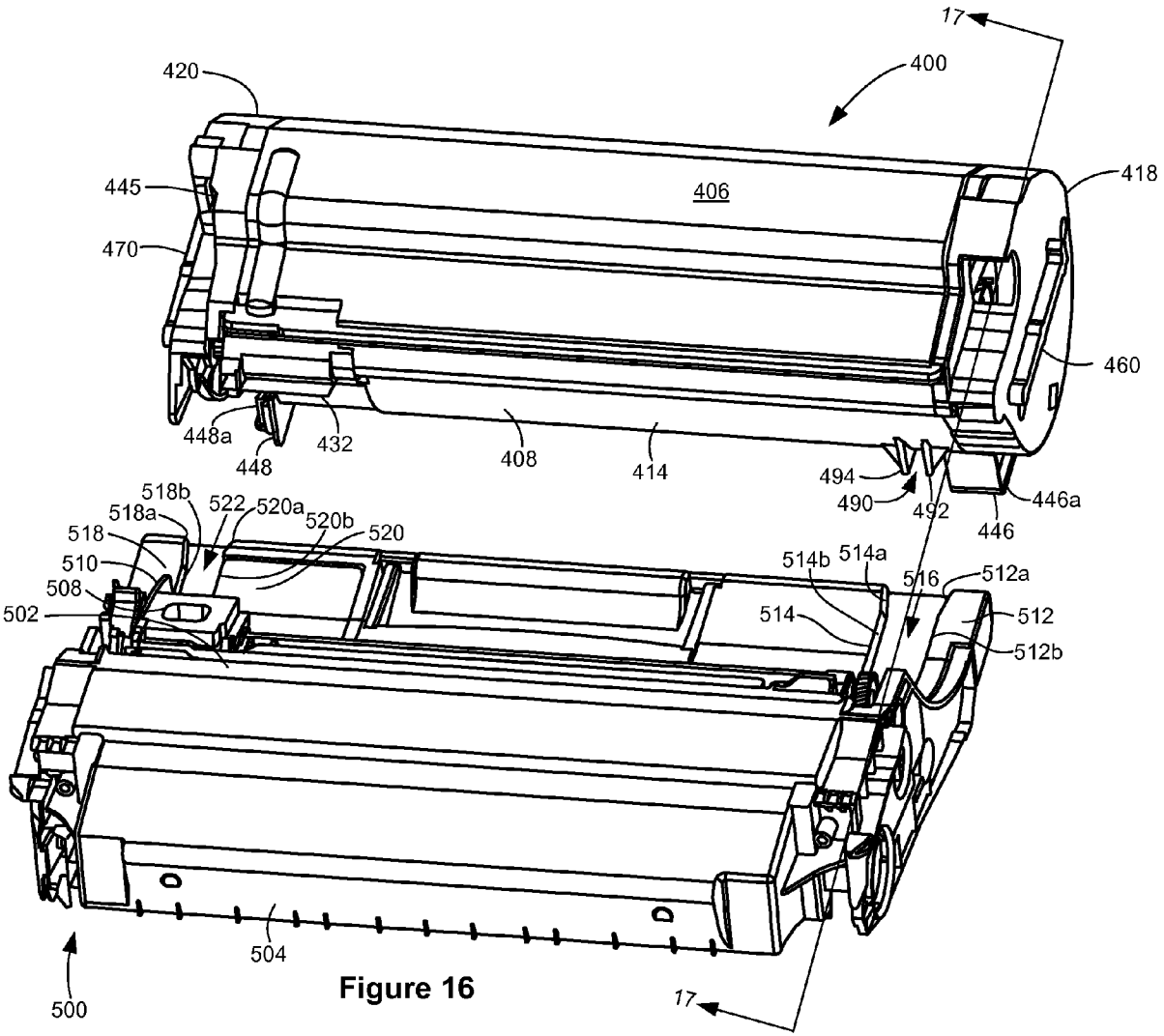
FIG. 16 is a top perspective view of the toner cartridge and imaging unit shown in FIG. 15.

With reference to FIGS. 15 and 16, toner cartridge 400 and imaging unit 500 include both coarse and fine axial positioning features. The coarse axial positioning features are similar to those discussed above with respect to toner cartridge 100 and imaging unit 200. Toner cartridge 400 includes a pair of legs 446, 448 extending downward from base 408. Frame 506 of imaging unit 500 includes a pair of vertical walls 512, 514 that form a guide 516 therebetween that receives leg 446 and a pair of vertical walls 518, 520 that form a guide 522 therebetween that receives leg 448 as toner cartridge 400 is inserted into image forming device 22. Each vertical wall 512, 514, 518, 520 includes a beveled front surface 512*a*, 514*a*, 518*a*, 520*a* that is outwardly angled with respect to the direction of insertion and faces toner cartridge 400 as toner cartridge 400 advances toward imaging unit 500. Front surfaces 512*a*, 514*a*, 518*a*, 520*a* guide toner cartridge 400 toward developer unit 502 as toner cartridge 400 is inserted into image forming device 22. Each vertical wall 512, 514, 518, 520 also includes an inner surface 512*b*, 514*b*, 518*b*, 520*b* that is substantially parallel to the direction of insertion of toner cartridge 400. Inner surfaces 512*b*, 514*b*, 518*b*, 520*b* restrain outer surfaces 446*a*, 448*a* of legs 446, 448 limiting the travel of toner cartridge 400 in the axial direction. In the example embodiment illustrated in FIGS. 15 and 16, the distance between outer surface 446*a* of leg 446 and outer surface 448*a* of leg 448 is between about 255 mm and about 258 mm.

Figure 17:
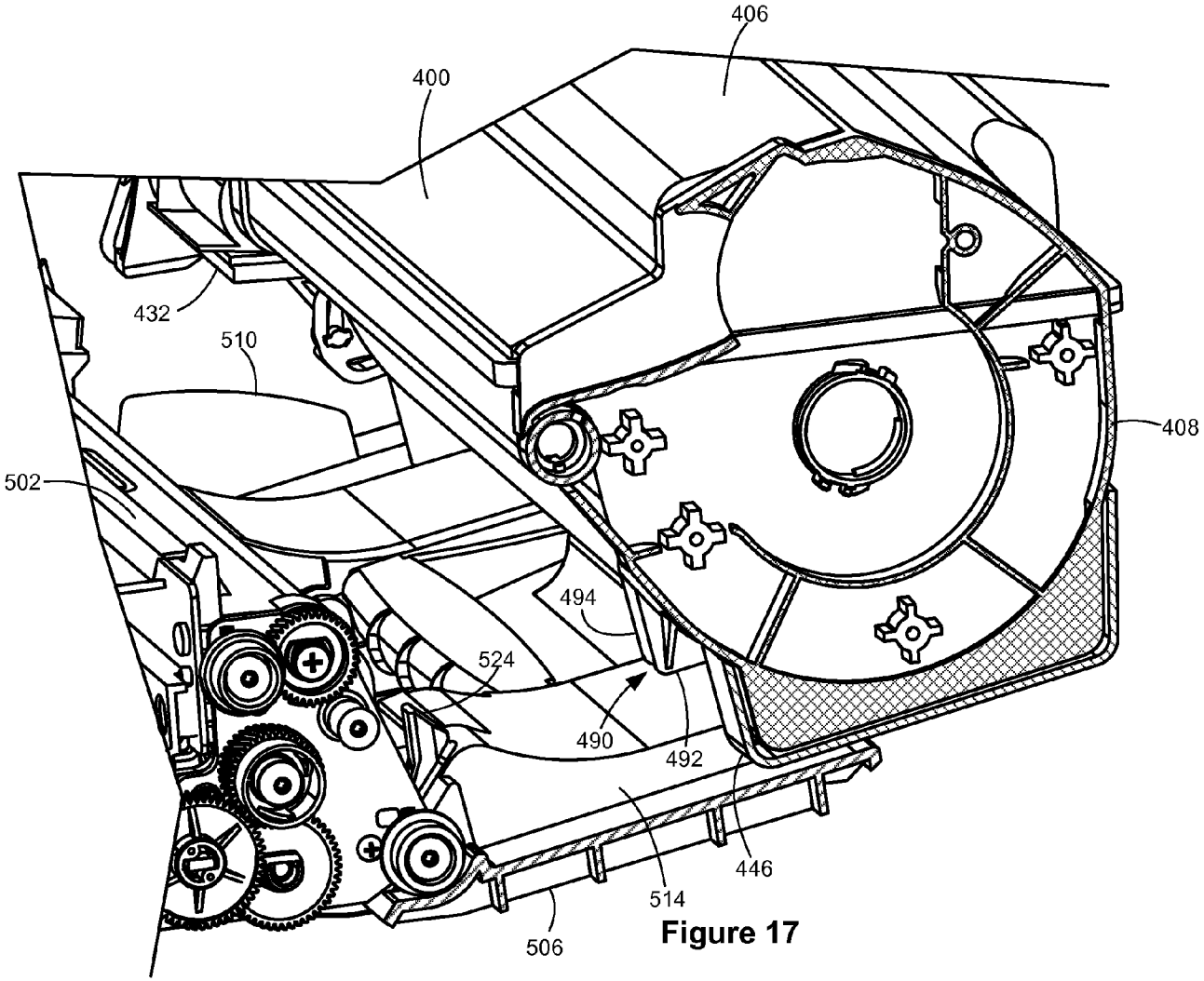
FIG. 17 is a cross-sectional view of the toner cartridge and imaging unit taken along line 17-17 in FIG. 16 with the toner cartridge advanced closer to the imaging unit.

FIG. 17 illustrates a cross-sectional view of toner cartridge 400 and imaging unit 500 taken along line 17-17 in FIG. 16. As shown in FIG. 17, a post 524 is spaced to axially inward from guide 516 and extends upward from frame 506 of imaging unit 500. Toner cartridge 400 includes a slot 490 formed between a pair of substantially parallel walls 492, 494 that extend forward and downward from base 408. Slot 490 is spaced axially inward from leg 446. In the example embodiment illustrated in FIG. 17, the width of slot 490 is between about 6.3 mm and about 8.3 mm. As toner cartridge 400 is advanced toward developer unit 502, post 524 on imaging unit 500 is tightly received in slot 490 on toner cartridge 400 permitting slot 490 to precisely maintain the axial position of toner cartridge 400. As desired, post 524 and/or slot 490 may include a tapered lead-in section to facilitate engagement between the two.

With reference back to FIGS. 15 and 16, the side surface of each end cap 418, 420 includes a wing guide 460, 470. Each wing guide 460, 470 includes the "dog bone" structure described above with respect to wing guides 160, 170 of toner cartridge 100. As discussed above, wing guides 460, 470 control the front-to-rear horizontal positioning and vertical positioning of toner cartridge 400. Each end cap 418, 420 also includes an engagement surface 452, 454 projecting upwardly from a top portion of the respective end cap 418, 420. As discussed above, each engagement surface 452, 454 includes an angled front surface 452*a*, 454*a* that faces imaging unit 500 during insertion and an angled rear surface 452*b*, 454*b* that faces away from imaging unit 500 during insertion. During operation, rear surfaces 452*b*, 454*b* of engagement surfaces 452, 454 receive a hold-down force from a component in image forming device 22 to ensure that exit port 432, main interface gear 430 and the electrical contacts for processing circuitry on connector 445 maintain their engagement with imaging unit 500 or image forming device 22.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A toner cartridge for use in an image forming device, comprising:

a housing having a reservoir for containing toner therein, the housing having an exit port in fluid communication with the reservoir to permit toner from the reservoir to pass out of the housing;

a first leg and a second leg each projecting from a bottom portion of the housing and extending between a rear portion and a front portion of the housing to limit the side-to-side travel of the toner cartridge during insertion into the image forming device;

a first wing guide positioned on a first side surface of the housing and a second wing guide positioned on a second side surface of the housing substantially parallel to the first wing guide, each wing guide having a generally elongated body that extends between the rear portion and the front portion of the housing;

a first stop extending from the first wing guide and a second stop extending from the second wing guide to limit the forward travel of the toner cartridge in the image forming device;

a pair of rounded projections extending from a bottom surface of the first wing guide and a rounded projection extending from a bottom surface of the second wing guide that define contact points to control the vertical position of the toner cartridge in the image forming device; and a slot on the front portion of the housing between the first and second legs that is sized to receive a corresponding projection in the image forming device to more finely control the side-to-side travel of the toner cartridge in the image forming device.

2. The toner cartridge of claim 1, further comprising an engagement surface projecting from a top portion of the housing for receiving a hold down force from the image forming device, the engagement surface including an angled front surface that faces toward the front portion of the housing and an angled rear surface that faces toward the rear portion of the housing.

3. The toner cartridge of claim 2, wherein the engagement surface includes a first engagement surface near the first side surface of the housing and a second engagement surface near the second side surface of the housing.

4. The toner cartridge of claim 1, wherein a top surface of each of the first and second wing guides includes a front portion that is angled downward with respect to a rear portion of the respective wing guide to facilitate insertion of the toner cartridge into the image forming device.

5. The toner cartridge of claim 1, further comprising a second rounded projection extending from the bottom surface of the second wing guide, wherein the radii of each of the pair of rounded projections of the first wing guide and the first rounded projection of the second wing guide are the same and the radius of the second rounded projection of the second wing guide is smaller than the radii of the pair of rounded projections of the first wing guide and the first rounded projection of the second wing guide.

6. The toner cartridge of claim 1, wherein the first stop extends from a top surface of the first wing guide and the second stop extends from a top surface of the second wing guide.

7. The toner cartridge of claim 1, wherein the slot is formed by a gap between a pair of walls that extend forward from the front portion of the housing.

8. A toner cartridge for use in an image forming device, comprising:

a housing having a reservoir for containing toner therein, the housing having an exit port in fluid communication with the reservoir to permit toner from the reservoir to pass out of the housing;

a first leg and a second leg each projecting from a bottom portion of the housing and extending between a rear portion and a front portion of the housing parallel to a direction of insertion of the toner cartridge into the image forming device, the first and second legs being spaced from each other on opposite sides of the housing to limit the side-to-side travel of the toner cartridge during insertion into the image forming device;

a first wing guide positioned on a first side surface of the housing and a second wing guide positioned on a second side surface of the housing substantially parallel to the first wing guide, each wing guide having a generally elongated body that extends between the rear portion and the front portion of the housing;

a first stop extending from the first wing guide and a second stop extending from the second wing guide to limit the forward travel of the toner cartridge in the image forming device;

a pair of rounded projections extending from a bottom surface of the first wing guide and a rounded projection extending from a bottom surface of the second wing guide that collectively form three datum points defining a plane that controls the vertical position of the toner cartridge in the image forming device; and a slot on the front portion of the housing between the first and second legs that is sized to receive a corresponding projection in the image forming device to more finely control the side-to-side travel of the toner cartridge in the image forming device.

9. The toner cartridge of claim 8, further comprising a first engagement surface projecting from a top portion of the housing near the first side surface and a second engagement surface projecting from the top portion of the housing near the second side surface for receiving a hold down force from the image forming device, each of the first and second engagement surfaces including an angled front surface that faces toward the front portion of the housing and an angled rear surface that faces toward the rear portion of the housing.

10. The toner cartridge of claim 8, wherein a top surface of each of the first and second wing guides includes a front portion that is angled downward with respect to a rear portion of the respective wing guide to facilitate insertion of the toner cartridge into the image forming device.

11. The toner cartridge of claim 8, further comprising a second rounded projection extending from the bottom surface of the second wing guide, wherein the radii of each of the pair of rounded projections of the first wing guide and the first rounded projection of the second wing guide are the same and the radius of the second rounded projection of the second wing guide is smaller than the radii of the pair of rounded projections of the first wing guide and the first rounded projection of the second wing guide.

12. The toner cartridge of claim 8, wherein the first stop extends from a top surface of the first wing guide and the second stop extends from a top surface of the second wing guide.

13. The toner cartridge of claim 8, wherein the slot is formed by a gap between a pair of walls that extend forward from the front portion of the housing.

* * * * *